United States Patent [19]

Boella et al.

[11] Patent Number: 4,778,289

[45] Date of Patent: Oct. 18, 1988

[54] ROTARY CHARACTER-CARRYING MEMBER AND SELECTOR DEVICE THEREFOR FOR A PRINT UNIT IN TYPEWRITERS

[75] Inventors: Marcello Boella, Loranzé; Mario Figini, Bosco Marengo, both of Italy

[73] Assignee: Ing. C. Olivetti & C., S.p.A., Ivrea, Italy

[21] Appl. No.: 857,348

[22] Filed: Apr. 30, 1986

[30] Foreign Application Priority Data

Apr. 22, 1985 [IT] Italy ..... 67375 A/85

[51] Int. Cl.[4] ..... B41J 1/30

[52] U.S. Cl. ..... 400/144.2; 400/175

[58] Field of Search ..... 400/144.2, 143, 144.1, 400/144.3, 145.1, 145.2, 175, 705.1

[56] References Cited

U.S. PATENT DOCUMENTS

| | | | |
|---|---|---|---|
| 4,281,938 | 8/1981 | Phillips | 400/144.2 X |
| 4,338,035 | 7/1982 | Kondo et al. | 400/144.2 |
| 4,553,868 | 11/1985 | Crosio | 400/175 X |
| 4,605,324 | 8/1986 | Musso | 400/144.2 |

FOREIGN PATENT DOCUMENTS

| | | | |
|---|---|---|---|
| 102248 | 3/1984 | European Pat. Off. . | |
| 0118277 | 9/1984 | European Pat. Off. . | |
| 119764 | 9/1984 | European Pat. Off. | 400/144.2 |
| 0181742 | 5/1986 | European Pat. Off. . | |
| 100084 | 6/1982 | Japan | 400/144.2 |
| 179351 | 10/1984 | Japan | 400/144.2 |
| 209895 | 11/1984 | Japan | 400/705.1 |

*Primary Examiner*—Charles A. Pearson

*Attorney, Agent, or Firm*—Banner, Birch, McKie & Beckett

[57] ABSTRACT

A print unit for an electronic typewriter comprising a removable character-carrying disc with flexible spokes which is operated by a selector motor which in turn is controlled by a control circuit. The character-carrying disc is provided with a plurality of reflective identification plates and a recognition circuit detects the pattern of the reflective plates present in selected ones of a series of predetermined angular sectors of the disc to identify some characteristics of the disc, e.g. typing pitch and character set. The angular position of the disc is detected by a position transducer which generates a position signal for the control circuit having a period which is double the angular distance between two contiguous character-carrying spokes discriminating the spokes at even positions from those at odd positions. In an initialization phase, a zeroing circuit coarsely positions the character-carrying disc in a zero area defined by a synchronization plate adjacent a plate-free gap and activates the control circuit to stop the character-carrying disc in a zero position in respect of a spoke having a predetermined parity. The print unit is provided with phase regulation elements for the position transducer and for the circuit for recognition of the reflective plates on the character-carrying disc.

8 Claims, 8 Drawing Sheets

ROTARY CHARACTER-CARRYING MEMBER AND SELECTOR DEVICE THEREFOR FOR A PRINT UNIT IN TYPEWRITERS

BACKGROUND OF THE INVENTION

The present invention relates to a rotary character-carrying member and the selector device therefor for a print unit of typing machines and in particular electronic typewriters, comprising a motor shaft which can be positioned in a plurality of angular positions and in which the character-carrying member can be removably connected to the motor shaft and is provided with identification elements disposed in a coded fashion along a circular ring thereon.

Typewriters which use character-carrying members with identification elements are generally provided with a detection or recognition circuit which, in an initialization phase of the machine, provides for rotary movement of the character-carrying member and for recognition of some characteristic parameters of the character-carrying member, thus simplifying use of the machine.

An arrangement of the above-described type is known in which the character-carrying member is of the daisywheel type, in which the motor shaft is rotated by a stepping motor and in which the circuit for recognition of the identification elements detects the coded position of the identification elements, recognises a particular reference position of the character-carrying member and activates the motor for a number of steps such as to position the character-carrying daisywheel in its zero position. That arrangement requires a recognition circuit which has a high degree of angular resolution and positioning of the identification elements which is so accurate as to discriminate the reference position with a maximum error that is less than half the angular step of the character-carrying petals. That is necessary in order to avoid the zero position of the daisywheel being associated with a different petal from the predetermined petal. The character-carrying daisywheel and the recognition circuit are therefore rather expensive.

SUMMARY OF THE INVENTION

The object problem of the present invention is to provide a character-carrying member provided with identification elements, and the selector device therefor, which are reliable and of restricted cost both individually and jointly.

That problem is solved by the selector arrangement according to the invention which, in accordance with a first characteristic thereof, comprises a position transducer having a movable portion synchronous with the character-carrying member and a detection portion which generates a position signal having a period which is double the angular spacing of two adjacent characters of the character-carrying member. A zeroing circuit which is controlled by the recognition circuit coarsely positions the character-carrying member in a zero area associated with the reference positions of the character-carrying member and a servo mechanism which is controlled by the position signal from the position transducer precisely stops the character-carrying member in a zero position which is unambiguously associated with the zero area and with a character thereof of predetermined positional parity.

In accordance with another characteristic, the character-carrying member is of the daisywheel type and the position of the identification elements is detected by a suitable detection member which generates a corresponding presence signal when an identification element is disposed in front of the detection member. Such member is mounted on a support which provides for angular regulation with respect to the print hammer. That makes it possible to modify the position of the detection member with respect to the character-carrying daisywheel and thus the phase of the presence signal with respect to a position of alignment of the character-carrying spoke with respect to the print hammer.

In accordance with a characteristic of the invention, the character-carrying daisywheel comprises, as identification elements, reflective identification plates and a reflective phasing or timing plate associated with the zero position. Each identification plate occupies an angular sector of constant width and the phasing or timing plate occupies an angular sector of an extent which is substantially less than that occupied by an identification plate.

In accordance with another characteristic, in addition to the identification elements for generating an identification code, the daisywheel comprises coded elements for generating a reference control code. That permits the electronic circuits of the typewriter to accept the identification code only if the reference control code is checked and found to be equal to a a control code calculated by the electronic circuit unambiguously from the identification code of the character-carrying daisywheel.

In accordance with another characteristic, besides the initialization means which detect the presence of coded identification elements for defining the zero position of the character-carrying member, the selector device comprises second initialization means which define the zero position of the character-carrying member, independently of the first initialization means. Other means detect non-reading of the phasing element and/or non-recognition of the identification code to activate the second initialization means.

In accordance with a further characteristic, the selector device comprises a transducer which produces a periodic position signal of variable amplitude in response to the rotation of the character-carrying member around given reference positions and a period which is equal to double the angular pitch of the characters. A motor has its rotor corrected to the character-carrying member for rotation thereof and a discrimination circuit activates the selector motor for an increasing direction of rotation upon an increase in the position signal for the characters having a given position parity and activates the selector motor for a decreasing direction of rotation upon an increase in the position signal for the characters of opposite parity.

A preferred embodiment of the invention is set forth in the following description which is given by way of non-limiting example and with reference to the accompanying drawings in which:

DESCRIPTION OF THE PREFERRED EMBODIMENTS

Figure 1:
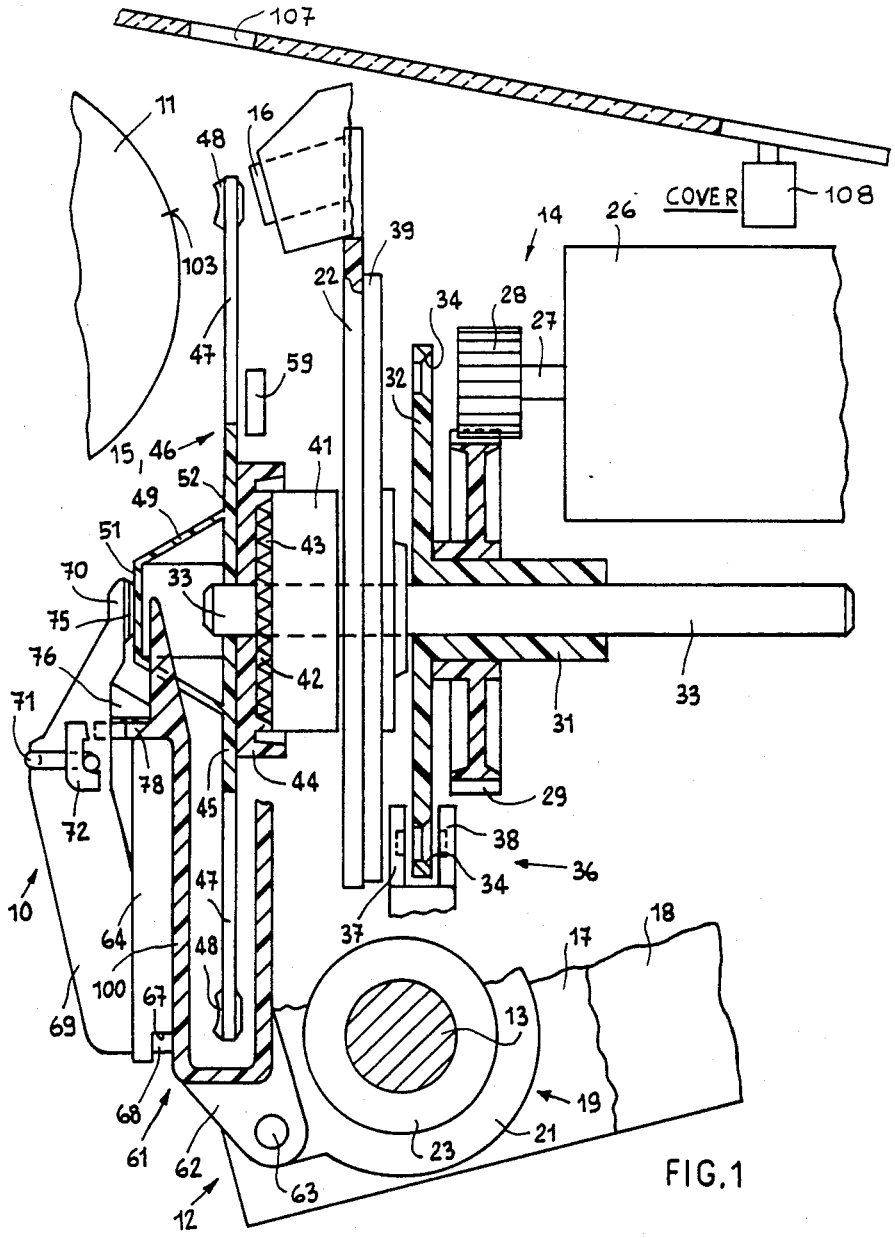
FIG. 1 is a partial longitudinal view of a typewriter using a print unit with the character-carrying member and the selector device according to the invention.

Referring to FIG. 1, the typewriter according to the invention comprises a platen roller 11 and a print unit formed by a carriage 12 which is movable on a cylindrical guide 13 parallel to the roller 11 and on a second guide which is not shown in the drawings. The carriage 12 carries a selector device 14 for a character-carrying member 15 or 46 of the disc or 'daisywheel' type, and a print hammer or striker 16. The carriage 12 comprises two side members 17 and 18 which are parallel to each other and orthogonal to the axis of the cylindrical guide 13. The translatory movement of the carriage 12 in front of the platen roller 11 is controlled in known fashion, for example as described in U.S. Pat. No. 4,553,868 assigned to Ing. C. Olivetti & C., S.p.A.

A frame 19 which is disposed between the side members 17 and 18 of the carriage 12 is of such a shape as to have two side members 21 which support a plate 22 parallel to the platen roller 11 and on which are mounted the hammer 16 and the selector device 14. The side members 21 of the frame 19 are fixed to two bushes 23 which are mounted coaxially to the cylindrical guide 13 inside the side members 17 and 18 of the carriage 12. In that way the frame 19 is pivoted with respect to the cylindrical guide 13 and follows the movements of the carriage 12 in front of the platen roller 11. A single bush 23 and a single side member 21 can be seen in the drawings.

The frame 19 and the plate 22 can rotate through 16° approximately with respect to the cylindrical guide 13, as described in above-mentioned U.S. Pat. No. 4,553,868.

The selector mechanism 14 comprises an electrical dc motor 26 which is capable of rotating in the clockwise and anticlockwise directions. The motor 26 has a shaft 27 on which there is fixed a pinion 28 that is always engaged with a toothed wheel 29 mounted on a sleeve 31 on a shaft 33.

The angular positions of the shaft 33 are detected by a transducer 36 comprising a synchronization disc 32 fixed on the shaft 33 and provided with a series of transmitting windows 34 disposed adjacent to the circumference thereof, a collimator or an illuminating means 37 and a photodetector 38, which are disposed on opposite sides with respect to the path of movement of the windows 34.

Figure 5:
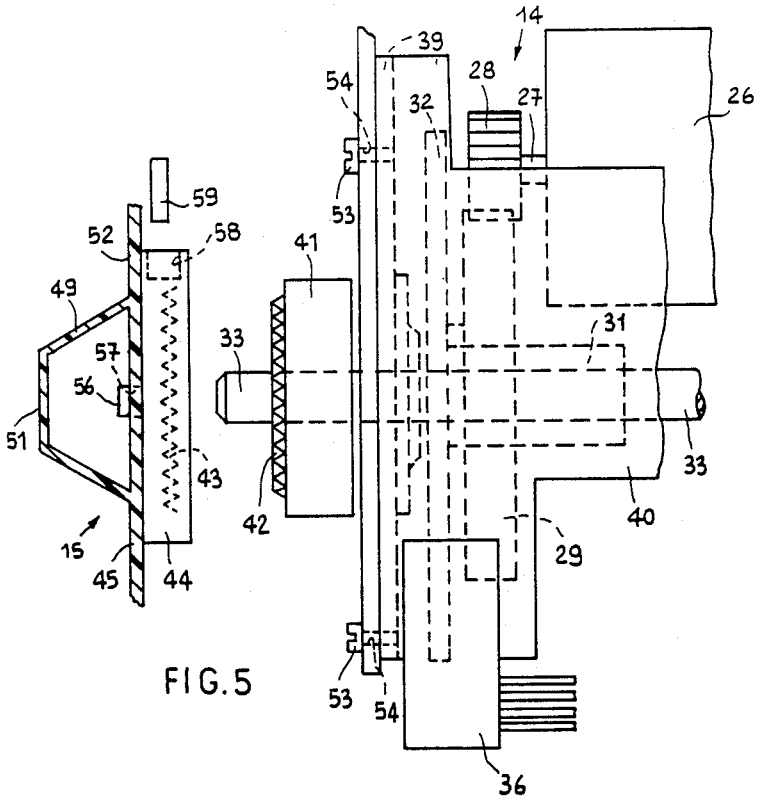
FIG. 5 shows a partly exploded longitudinal view of some details from FIG. 1.
Figure 6:
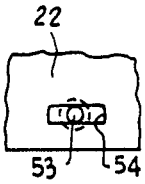
FIG. 6 shows a partial front view of some details from FIG. 5.

The shaft 33 is rotatable in a flange 39 (see FIG. 5) of a container 40 which is mounted in such a way that it can be angularly adjusted by means of three screws 53 disposed at 120° to each other, housed in respective slots 54 in the plate 22. Only two screws 53 and two slots 54 can be seen in the drawings. FIG. 6 shows a detail of the slots 54 in the plate 22 for the screws 53.

A sleeve 41 (see FIG. 5) is fixed on the shaft 33 and comprises front-mounted coupling means 42 capable of coupling with corresponding coupling means 43 on an adaptor disc 44 mounted on the character-carrying disc 15 or 46. The disc 46 is of known type, for example of the type described in U.S. Pat. No. 4,036,548 assigned to Ing. C. Olivetti & C., S.p.A. and comprises a central hub 45 (see FIG. 1) and a hundred radial and flexible spokes or 'petals' 47 which carry a respective print character 48 at their ends. A gripping portion 49 having a front wall 51 is fixed to a front surface 52 of the central hub 45.

Figure 4:
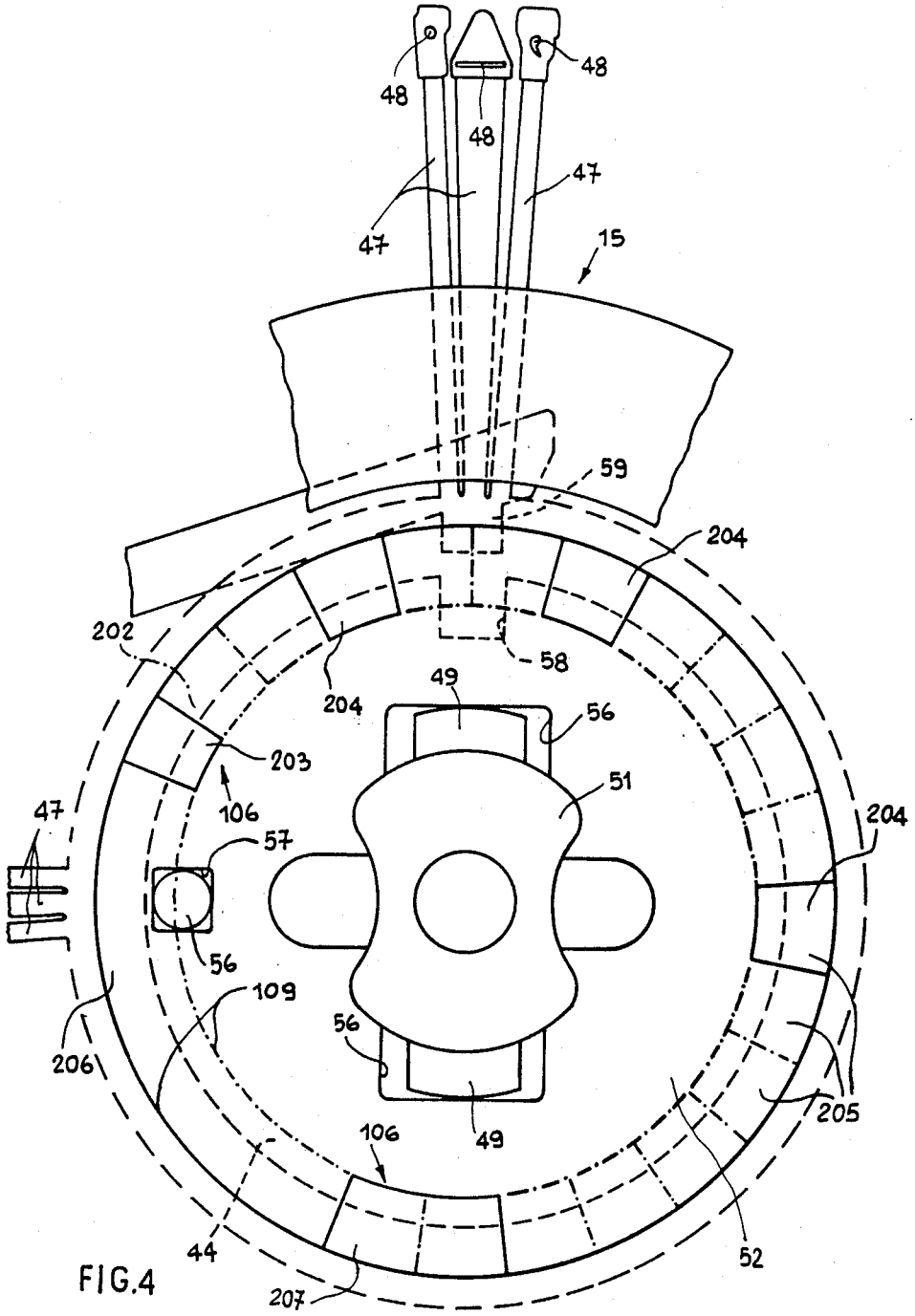
FIG. 4 shows a partial front view of the character-carrying member of FIG. 1 on an enlarged scale.
Figure 7:
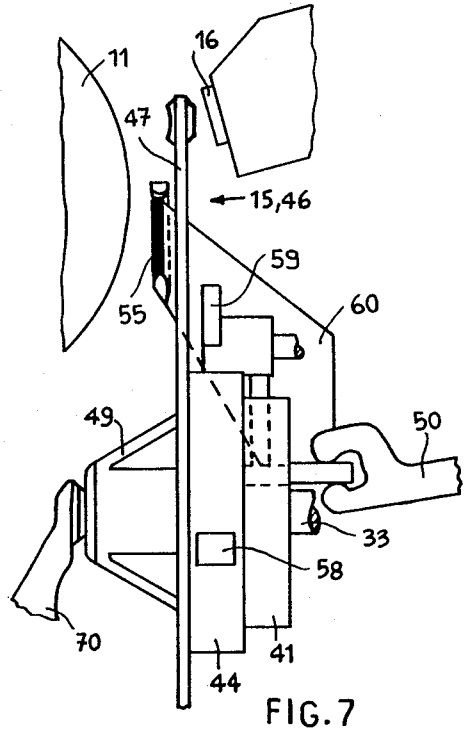
FIG. 7 shows another partial view of the selector device according to the invention.

The adaptor disc 44 is of known type, for example of the type described in European patent application EP No. 0 118 277. The disc 44 is of plastics material and is of such a configuraiton as to couple on the one hand with the hub 45 of the character-carrying disc 15 and on the other hand with the sleeve 41. More particularly, the disc 44 comprises two pairs of hooks or catches (not shown in the drawings) which project perpendicularly and which are arranged to engage into respective cavities 56 (see FIG. 4) in the character-carrying disc 46 to connect the two discs 44 and 46 together, as described in above-mentioned European patent application EP No. 0118277. A cylindrical peg 56 for angular positioning is arranged to co-operate with the hole in the character-carrying disc 46 for angularly positioning the disc 44 and the character-carrying disc 15 or 46 relative to each other. Provided on the outside periphery of the adaptor disc 44 is a seat 58 for receiving a tooth 59. The tooth 59 is elastically connected to a frame 60 (see FIG. 7) for lifting a correction ribbon 55 which can be lifted by a control element 50 of the type described in U.S. Pat. No. 4,601,596 and is part of the arrangement for the zero positioning operation described in U.S. Pat. No. 4,605,324.

Figure 2:
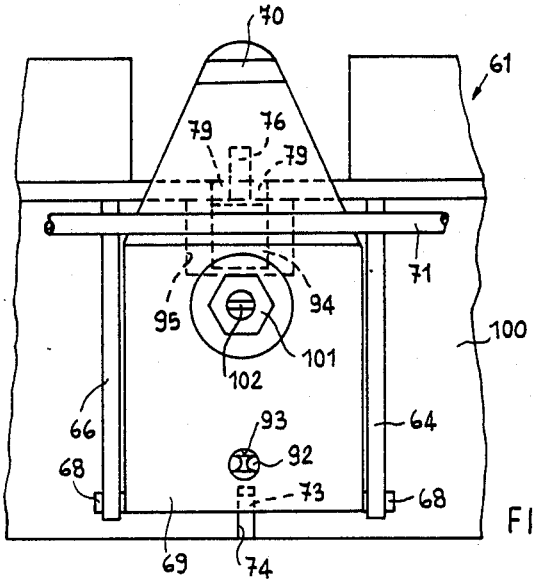
FIG. 2 shows a partial front view of some details from the FIG. 1 construction.
Figure 3:
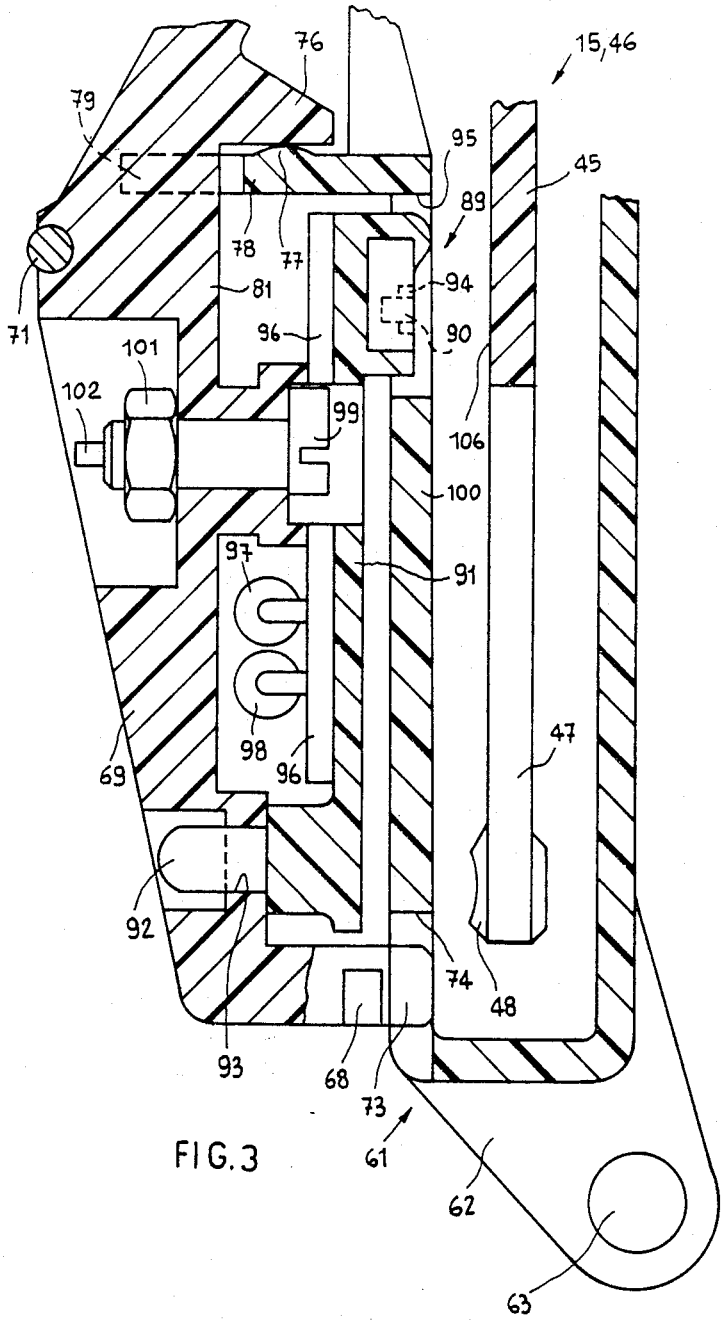
FIG. 3 shows a partial longitudinal view in section on an enlarged scale of some details from the FIG. 1 construction.

A tray member 61 (see FIG. 1) of plastics material is disposed substantially vertically between the frame 19 and the platen roller 11. The tray member 61 is of substantially parallelepipedic shape, being hollow internally, for housing the character-carrying disc 46. The tray member 61 is laterally provided at its bottom with two lugs 62 of which only one is shown in the drawings and which are each pivoted on a pin 63 on the frame 19. The tray member 61 further comprises two ribs 64 and 66 (see FIGS. 1 and 2), each of which has a seat 67 for housing a leg 68 of a lever 69. The lever 69 is constantly urged towards the ribs 64 and 66 on the tray member 61 by a spring 71 formed by a steel bar, the ends of which are engaged to two vertical legs 72 of which only one is shown in the drawings and which are disposed at the sides of the tray member 61. The lever 69, by means of the end 70 and the element 75, normally bears against the front part 51 of the gripping portion 49 to maintain the coupling between the portions 41 and 42 during the rotary movement of the daisywheel 15. The lever 69 is provided with a lower leg 73 (see FIG. 3) housed in a seat in the tray member 61 and an upper leg 76 which is capable of engaging a projection 77 on a plate portion 78, in turn provided with two legs 79 for engaging a vertical plate portion 81 of the lever 69.

An intermediate support 91 of plastics material has a pin 92 which can be housed in a seat 93 in the lever 69 and supports a photoelectric pair 89 comprising, in side-by-side relationship, an illuminating element 90 and a photosensing element 94, which are housed in a seat or opening 95 in a front wall 100 of the tray member 61. The photoelectric arrangement 89 is part of a recognition circuit carried by a printed circuit 96 of which components 97 and 98 have been shown. The intermediate support 91 is fixed to the lever 69 by means of an eccentric screw 99 having a nut 101 and a recording sector 102, which permit the photoelectric arrangement 89 to change its angular position with respect to the character-carrying disc 15.

The electronic typewriter as described hereinbefore may alternatively mount character-carrying daisywheels 46 (see FIG. 7) of the type which is already known or daisywheels 15 which are substantially identical to the disc 46 but which are further provided with reflection identification plates 106 (see FIG. 4) disposed in a coded fashion in twenty five sectors of a circular ring 109 on the front wall 52.

The machine further comprises a transparent cover 107 which, when it is closed, protects the region in which the carriage 12 moves in front of the platen roller 11 and which acts on a microswitch 108. Any replacement of the daisywheel 15 or 46 requires the cover 107 first to be opened, and causes the production of a signal COVER by the microswitch 108.

Setting of the above-described structure is effected in the following manner:

In order to provide the proper phase relationship between the selector device 14 (see FIG. 1), the character-carrying disc 15 or 46 and the striker hammer 16, by means of an electronic control member 170 and for a selection cycle as described hereinafter, the motor 26 is operated which, by means of the pinion 28 and the toothed wheel 29, rotates the synchronization disc 32 and the daisywheel 15 or 46. The optical transducer 36 detects the movement of the windows 34 therepast and the control member 170 rotates the character-carrying disc 15 or 46 until the signal from the transducer thus assumes a reference zero value. One of the one hundred petals 47 will then be coarsely positioned in front of the typing point 103.

A check is now made to ascertain whether the axis of the hammer 16 is aligned with the axis of the selected character 48. In the situation which can be easily envisaged that the above-mentioned axis is not in an aligned condition, the three screws 53 (FIG. 5) are slackened off and the container 40 together with the selector device 14 and with the daisywheel 15 or 46 is rotated with respect to the plate 22 in a clockwise or anticlockwise direction until the axis of the hammer 16 (FIG. 1) coincides with the axis of the character 48. At that point the three screws 53 (see FIG. 5) are locked and the character which is positioned in front of the typing point 103 or any other character which is similarly selected will be perfectly aligned with the axis of the hammer 16.

Subsequently, the position of the photoelectric arrangement 89 (see FIG. 3) is regulated by means of the eccentric screw 99. For that purpose, a 'specimen' daisywheel (not shown in the drawings) comprising a single petal and a single reflective zone 106 is fitted in position. The daisywheel is disposed in front of the arrangement 89, the illuminating element 90 is supplied with a predetermined current and the current at the photosensor element 94 is detected. The nut 101 is then slackened and, by means of the registration sector 102, the eccentric screw 99 is rotated. The support 91 is thus rotated in a clockwise or anticlockwise direction together with the photoelectric arrangement 89 and the printed circuit 96, thus modifying the relative angular positioning as between the arrangement 89 and the reflective plate.

The rotary movement as between the arrangement 89 and the 'specimen' daisywheel continues until there is detected at the photosensor 94 a preset current value which conventionally increases in response to an anticlockwise rotation of the support 91, indicating that only the input or leading edge of the plate is aligned with the arrangement 89. That value is intermediate between the maximum value associated with the presence of a reflective plate precisely aligned with the arrangment 89, and the minimum value associated with the absence of reflective plates. When that intermediate value is attained, the nut 101 is locked and the recognition circuit is set.

Under operating conditions, the signal at an intermediate value from the element 94 is such as to activate a circuit 109 (see FIG. 8) for switching to zero a signal REMAIN that is normally at high logic level.

Selector motor control

The motor 26 is servo-controlled by the electronic circuit 170 of the machine (FIG. 8) comprising a microprocessor 171 with a central unit 168 connected to an input-output unit 169 and a print control unit (PCU) 172. The input-output unit 169 receives and/or transmits signals from the input members of the machine such as the keyboard and other external memory units and receives other signals such as inter alia the signal REMAIN coming from the photosensor 94 and the signal COVER coming from the microswitch 108. The unit 172 controls the motor 26 by means of an integrated logic-analog circuit (IC) 173 and a switching-type feeder 174 substantially as described in U.S. Pat. No. 4,605,887 assigned to Ing. C. Olivetti & C., S.p.A. and European application No. 85307893.9 (publication EP No. 0181742).

Briefly, the feeder 174 feeds the motor 26 with a current whose magnitude depends on the relationship between two pulses of opposite signs, PW1 and PW2 of a frequency which is fixed and high with respect to the activation times of the motor and of variable relative duration. The pulses PW1 and PW2 are obtained from a pulse Q of a pulse modulator (PWM) 182, the duration thereof in turn being controlled by a decoder 183 of the circuit 170, in response to the state of three logic signals M1, M2 and M3. The relationship between PW1 and PW2 is variable in a range of between 0 and 0.5 for a first direction of movement or between 0.5 and 1 for a direction of movement which is opposite to the first, in per se known manner. The two ranges are determined by the instantaneous state of the signals M1 and M2.

The pulse modulator 182 receives feedback signals from the transducer 38 and from the motor 26 and defines the value of the relationship between the signals PW1 and PW2 in the range determined by the signals M1 and M2. For that purpose, the modulator 182 is connected to the photodetector 38 by way of a preamplifier 181, an amplifier 184, an amplifier 185 and a dynamic limiter 186, and to the stator circuit of the motor 26 by way of a current sampling resistor 187.

The fifty transmissive windows 34 in the synchronization disc 38 are equally spaced from each other. Due to the effect of irradiation by the illuminating means 37 and the rotary movement of the disc 32, the output signal A from the pre-amplifier 181 disposed on the output side of the photodetector 38 is thus trapezoidal. The amplifier 184 subtracts from the signal A a reference signal VR and provides a signal FTA (see FIG. 9) which is symmetrical with respect to VR, also being trapezoidal, whose amplitude, in the vicinity of the position of alignment of each petal with respect to the hammer, is proportional to the angular displacement of the petal with respect to its position of alignment.

The signal FTA, in response to a clockwise rotation of the character-carrying daisywheel 15 or 46, presents fifty rising edges 188 (see FIG. 9) and fifty falling edges 189, so that the period of the signal FTA is double the angular distance between two adjacent petals of the daisywheel 15 or 46. The angular spacing between the two edges 188 and 189 is therefore equal to the angular spacing between the axes of three adjacent spokes 47 of the daisywheel 15 or 46. The reference voltage VR is also regulated in such a way that two contiguous zero points Xo and X'o of the signal FTA of the two edges 188 and 189 correspond to the angular spacings between the axes of two adjacent petals 47 of the daisywheel 15 or 46.

The dynamic limiter 186 (FIG. 8) limits the amplitude of the signal FTA at the input to the amplifier 185, to a preset value. Below the maximum value, the signal at each edge 188 is substantially proportional to the angular displacement of each petal at an 'even' position with respect to the position of alignment with the hammer, while the signal of each edge 189 is substantially proportional to the opposite or reverse of the angular displacement of each petal in an odd position. The decoder 183, in response to the low state of the signal M3, can produce a signal T which sends the dynamic limiter 186 into a condition of saturation, independently of the value of FTA and, in response to a particular state of the signals M1 and M2, supplies a signal G which modifies the gain of the amplifier 185.

Figure 8:
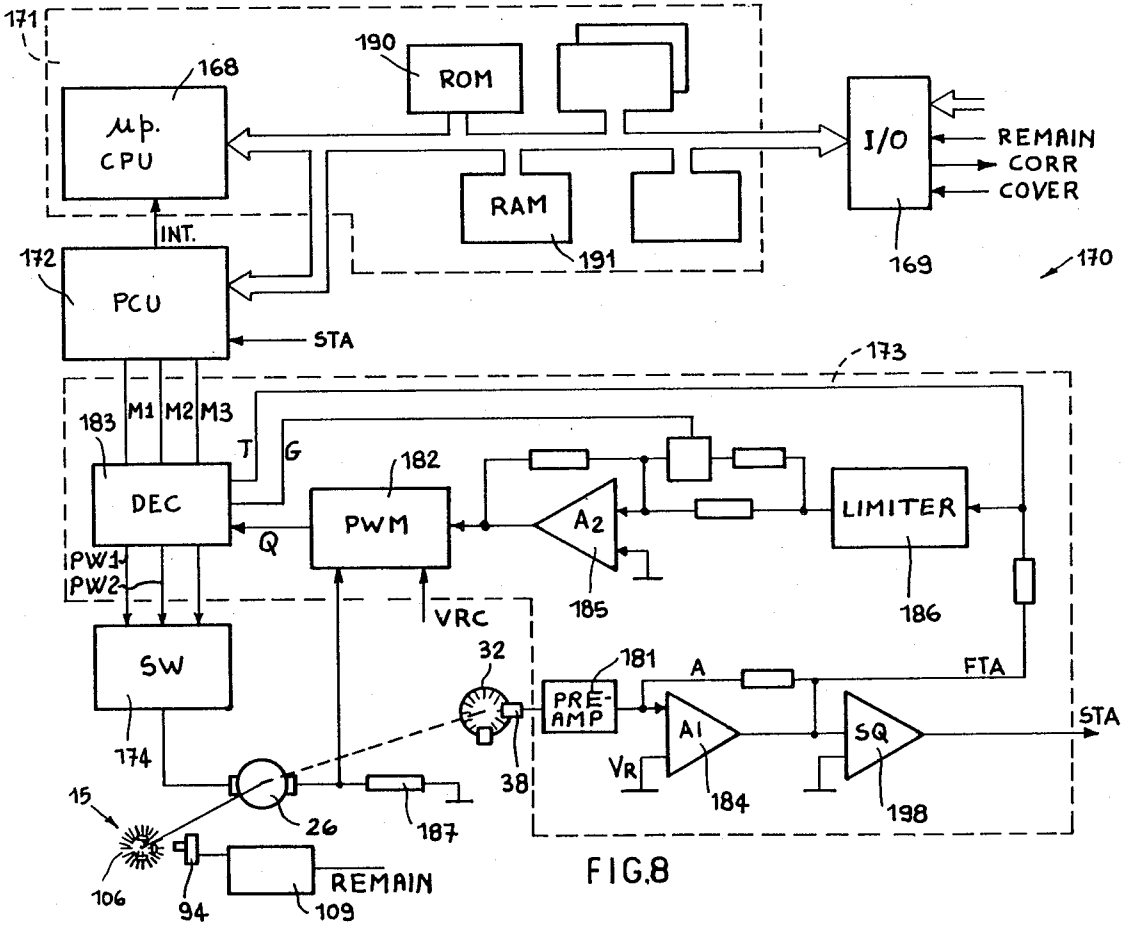
FIG. 8 shows a block circuit diagram of the control circuit of the selector device according to the invention.

A squaring circuit 198 supplies a squared signal STA corresponding to the movement of each petal in front of the position of alignment with the hammer (FTA=$\phi$) and the control circuit 172 responds to the edges of the signal STA selectively to generate an interrupt signal INT (See FIG. 9) for the microprocessor 172 (see FIG. 8). The values of M1, M2 and M3 are up-dated in response to processing operations internal to the circuit 172 and in response to fresh information received by the microprocessor 171. In addition the rising and falling edges of the signal STA in turn represent the moment at which the respectively even and odd petals pass in front of the hammer 16.

As described in above-mentioned U.S. Pat. No. 4,605,887, the state of the signals M1, M2 and M3 determines the following conditions:

| | |
|---|---|
| M1 = 1 M2 = 1 M3 = 1 | Motor disabled |
| M1 = 0 M2 = 1 M3 = 1 | Short circuit |
| M1 = 1 M2 = 0 M3 = 1 | Anticlockwise movement |
| M1 = 0 M2 = 0 M3 = 1 | Clockwise movement |
| M1 = 0 M2 = 1 M3 = 0 | Motor stopped at the rising edge of STA, low gain |
| M1 = 1 M2 = 0 M3 = 0 | Motor stopped at the rising edge of STA, high gain |
| M1 = 1 M2 = 1 M3 = 0 | Motor stopped at the falling edge of STA, low gain |

-continued

| | |
|---|---|
| M1 = 0 M2 = 0 M3 = 0 | Motor stopped at the falling edge of STA with high gain |

When the petal of the character 48 to be selected is far from the print position, M3 is at level 1, the signal T puts the dynamic limiter 186 into a condition of saturation and the signal Q of the modulator 182 supplies current pulses whose maximum value is determined by a reference signal VRC, in the direction of movement fixed by the microprocessor 171. Control of the motor is thus of time-dependent digital type.

The configuration of the signals M1 and M2 is varied in the varying periods of time between different angular steps, in dependence on the difference in time between the actual time of passage in the preceding period and a theoretical time which is read in a memory ROM 190 of the microprocessor 171. The theoretical times in the ROM 190 are preset in dependence on the number of angular steps to be performed and provide acceleration phases and braking phases in order to minimise the total selection time. A movement command in accordance with the actual direction of movement of the motor causes acceleration. In contrast, a movement command which is not in accordance with the actual direction of movement causes braking of the motor. In the situation indicated as short circuit, the motor is subjected to a weak braking action independently of the direction of rotation thereof.

The signals M1 and M2, even in the period between the two edges of the signal STA, are generally variable. A first phase of each digital control in the period between two signals INT provides for acceleration or braking substantially as far as half the angular step between two petals and takes account of the difference between the actual time of passage and the theoretical time in the preceding period between two INT and due to a movement which is respectively slower or faster than the theoretical movement. That phase is followed by a short circuit phase until the theoretical time has elapsed. In the case where the motor in the current period has been slower than the speed envisaged, the circuit 172 immediately detects that there has been a lag and immediately generates a pair of values M1 and M2 which causes acceleration in advance of the motor, aimed at making up the lag.

That process continues until the penultimate petal passes in front of the striker. At that time, the circuit 172 generates for a fixed time a pair of values M1 and M2 which permit the petal of the desired character to reach an approximate print alignment zone, up to about half a step from the striker. The circuit 172 then immediately switches the signal M3 to zero and activates an alignment phase with a particular configuration of the signals M1 and M2. The signal M3=0 puts the signal T to zero and the signal FTA can modify the input signal of the pulse modulator 182 by way of the limiter 186 and the amplifier 185 so that the current in the motor 26 is proportional to the angular displacement of the petal from its position of alignment. The control of the motor is therefore of analog-positional type.

Figure 11:
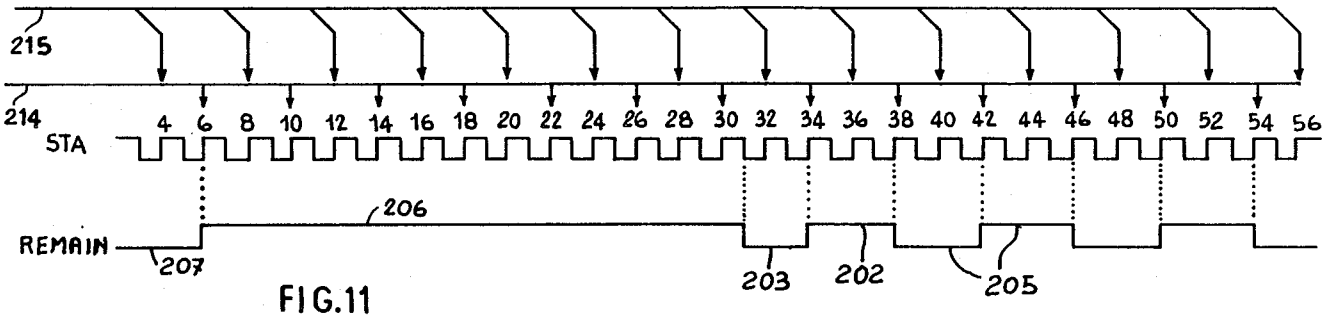
FIG. 11 is a diagram showing other signals of the circuit illustrated in FIG. 8.

The correspondence of fifty windows 34 with the one hundred petals 47 of the daisywheel 15 or 46 has the consequence that, according to whether a petal of 'even' position or a petal in an 'odd' position is disposed in front of the hammer, the edges of the signal FTA are inclined in opposite directions. FIG. 11 relates the characters at even positions 221 with the signal STA. The microprocessor 172, in each character selection phase subsequent to the initialization phase which will be described hereinafter, controls the positional parity of the character to be typed or printed. Upon switching of M3=0 in the region in which the signal FTA is the same, the microprocessor 172 imposes on the signals M1 and M2 a configuration which is dependent on the positional parity in respect of the petal in an aligned condition.

Figure 9:
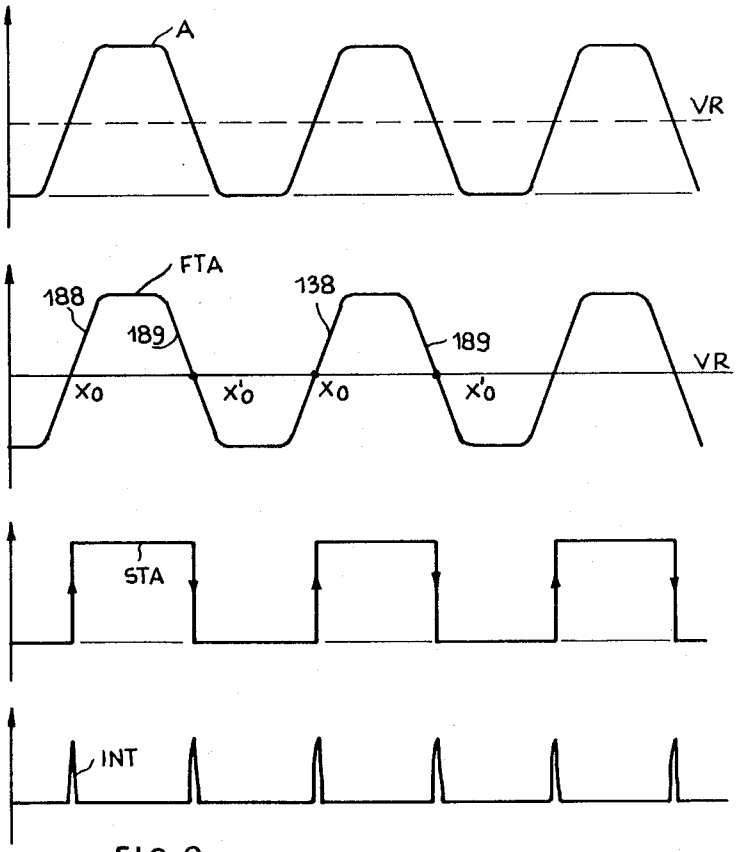
FIG. 9 shows a diagram representing some signals of the circuit shown in FIG. 8.

If the desired character is in a conventionally even position, the signals STA and FTA are rising in response to a clockwise rotation of the daisywheel and the movement stops at the point Xo in FIG. 9. In that condition, the microprocessor 171 imposes a configuration M1=0 and M2=0 and a current of conventionally positive sign at the motor 26 for each positive value of FTA. If the desired character is in an odd position, the signals STA and FTA are falling in response to an counterclockwise rotation of the daisywheel and the movement stops at the point X'o and the microprocessor 172 imposes the configuration M1=1, M2=0 and a negative current at the motor 26 for each positive value of FTA. In that way the rising and falling zero points Xo and X'o respectively of the signal FTA are both stable points of the servo mechanism.

Character-carrying daisywheel with reflective plates

In accordance with the invention, the plates 106 (see FIG. 4) comprise a phase timing or synchronization plate 203 (indicated at 1 in FIG. 12) which occupies an angular sector which is congruent with that of three character-carrying petals 47, a sector 202 of four petals (indicated at 2 in FIG. 12) which is without plates, and a group of other plates 204 (from 3 to 19 in FIG. 12) which can occupy selected ones of seventeen contiguous angular sectors 205 of a coded zone and in which each sector 205 is congruent with a sector of four petals 47. The remaining portion which corresponds to five sectors of four petals and one sector of five petals (from 20 to 25 in FIG. 12) is in contrast without plates and defines a non-reflective space (gap) 206 between the synchronization plate 203 and a last position 207 along the circular ring or array 107. The sectors of the coded zones, which are left without the reflective plates, outside the gap 206, are in any case fewer than six.

When the setting phases have been completed in the manner already described above, for each petal 47 in a position which is even and a multiple of four aligned with the hammer, the photosensor 94 detects the condition of illumination of a part of one of the twenty five sectors in which the plates 106 can be positioned. Alignment with the hammer of the even petals which are not a multiple of four corresponds to alignment with the input or leading edge (for a clockwise rotary movement) of the sector for positioning of the plates 106. Under those conditions, for the odd petals and for the even petals with a position which is a multiple of four (indicated by 215 in FIG. 11), the output signal of the circuit 109 generates the signal REMAIN=0 when a reflective plate is present and the signal REMAIN=1 in the absence of a plate, including in the situation where the plates are displaced from their theoretical position with respect to the positioning sectors. The signal REMAIN will be of an ambiguous value dependent on the phase displacement of the plates with respect to the theoretical position, for the petals at even positions which are not a multiple of four (indicated at 214 in FIG. 11). For illustrative purposes FIG. 11 is drawn for the case in which the first few sectors 205 are alternatively with and without plates.

The seventeen coded positions define thirteen bits which form an identification code and four bits which form a reference control code. The plates of the identification code are subdivided into three groups of which a first group 208 of three bits (A, B, C) (FIG. 12) represents the spacing pitch of the characters 58 (for example 1/10", 1/12", 1/15", P5), a second group 205 of three bits (A, B, C) represents the mean dimensions of the characters and influences the mean strength of striking, and a third group 210 of seven bits (A, B, C, D, E, F, G) is indicative of the linguistic grouping to which the daisywheel belongs. The reference control code of a fourth group of plates 211 represents in binary code the sum of the bits REMAIN=1 contained in three groups of plates 208, 209 and 210.

Figure 10:
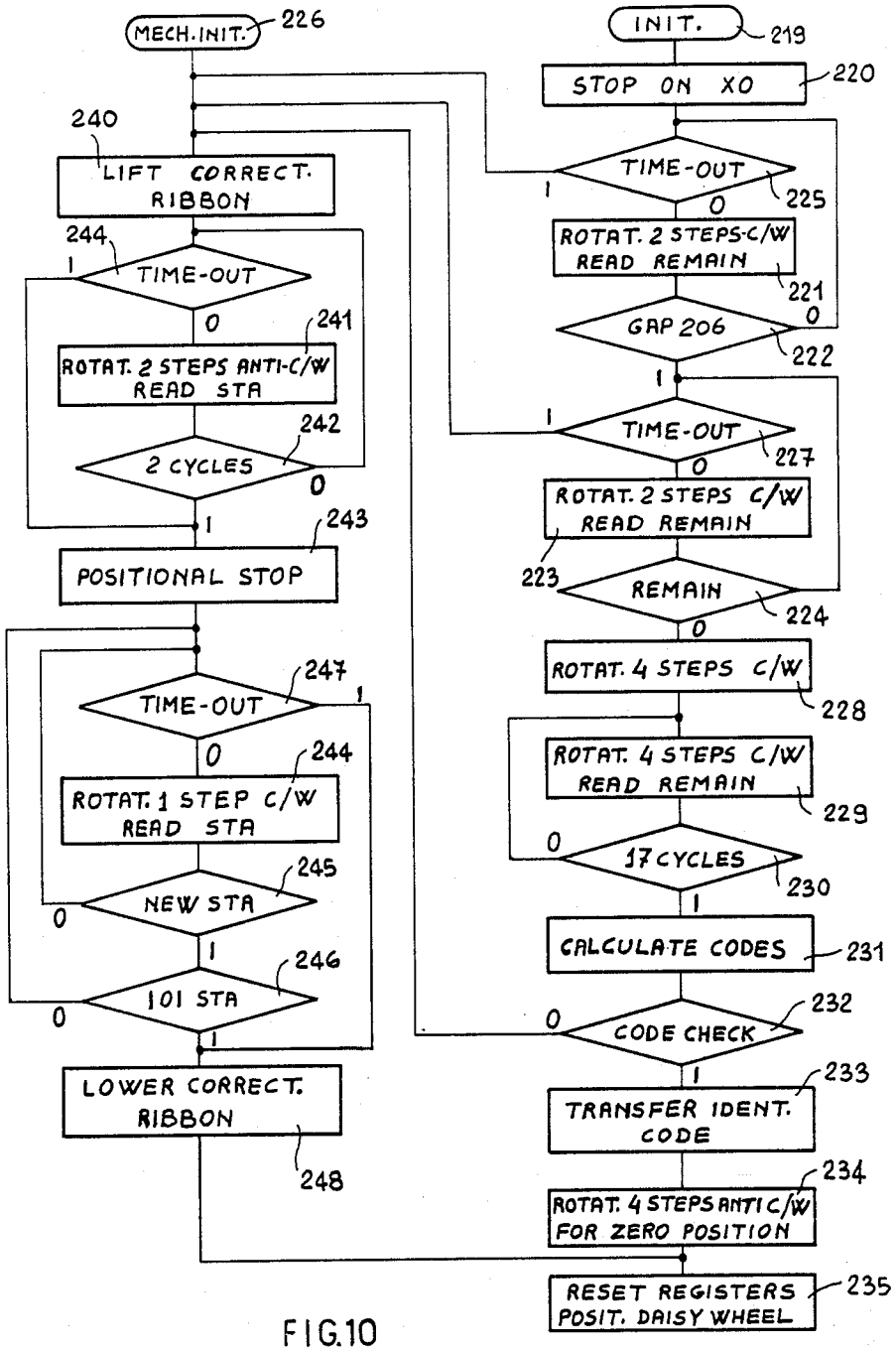
FIG. 10 is an operating diagram of the circuit shown in FIG. 8.

The initialization phase indicated at 219 in FIG. 10 follows a state of zeroing of the memories RAMs 191 of the microprocessor 172. The ROMs 190 of the microprocessor 171 comprise locations intended for a program which produces the initialization phase in accordance with the following steps:

Block 220 for seeking the rising edge of the signal STA. The program activates a configuration M1=1, M2=0, M3=0 for a predetermined period of time (3.2 msec) which tends to cause the synchronization disc to reach a position Xo in an counterclockwise direction, after passing through the short-circuit state M1=0, M2=1, M3=1, for a second fixed period of time (4.8 msec), and subsequent return to positional control M1=1, M2=0, M3=0. The initialization program also provides a waiting state and a short rotary movement in a clockwise direction, which is controlled in respect of time, to ensure that the synchronization disc is not incorrectly stopped at the point X'o which is intrinsically unstable in the configuration M1=0, M2=1. That rotation is followed by a series of cycles which alternate the positional control in the configuration M1=1, M2=0, M3=0 with the short circuit state M1=0, M2=1, M3=1. At the end, the program stops the disc in the configuration M1=0, M2=1, M3=0, corresponding to a condition of alignment of petals of even positions in front of the striker and a positional control associated with a state of low gain of the amplifier 185 and low current in the motor 26.

In that state, the daisywheel is stopped in a position such that the photosensor 94 receives the light from one of the reflective plates, if it is present and is in the appropriate phase, and sets the signal REMAIN=0, or the photosensor does not receive any light and the signal REMAIN=1, in the case where there is no plate in the stop position, or the edge of the plate is out of position.

In the block 221, the program proceeds with a rotary movement of two petals in a clockwise direction with a digital control at low speed, and the subsequent reading of REMAIN. The operation is repeated until (block 222) REMAIN=1 is read for 12 times, indicating that the gap 206 has been identified.

If the gap has not been found, the program continues to rotate the daisywheel until a timer (junction 225) signals that the time intended for that phase has elapsed; in that case the program proceeds to start a mechanical zeroing cycle 226 which will be described hereinafter.

When the gap 206 has been found in the block 223, the program provides a further rotary movement of two petals and reading of REMAIN. If it is found (junction 224) that REMAIN=0, that indicates in an unambiguous fashion that the daisywheel which is fitted in position has the reflective synchronization plate 207 after the gap 206 and that that plate associated with the positioning petal member 32 has been identified. If that is not the case, the time control (block 229) activates the mechanical initialisation cycle 226.

In the case where the signal petal 32 has been identified, the program also causes a rotary movement of the four petals in a clockwise direction (block 228) for reading REMAIN=1 in the central zone of the sector 202 which is without plates. Subsequently (block 229 and junction 230), the program performs seventeen cycles each comprising a rotary movement in an anticlockwise direction corresponding to four petals for alignment of the petals at positions which are a multiple of four and reading REMAIN (block 231). The program proceeds (block 231) with arithmetic summing of the number of bits REMAIN=1 which are read in the three groups of plates 208, 209 and 210, and compares the number calculated in that way to the code which is read in the group 211 (junction 232). In the case where the code read and the code calculated are not the same, the program proceeds to activate the mechanical initialization cycle 226. In the case of the codes being the same, the program transfers the codes read into the RAM 191 (block 233) and proceeds with a rotary movement of four petals in an counterclockwise direction (block 234) to a position of alignment of the petal with the underlining character (_), zero position, in front of the striker. Finally, the program (block 235) resets the registers of the RAMs 191 which are representative of the angular position of the daisywheel.

The structure of the reflective plates as defined hereinbefore, in combination with correct positioning of the synchronization disc 32 permits the daisywheel to be put into its zero position, even if the plates are displaced from their theoretical position by an angle of up to more or less half the angular step or pitch of the petals 47. That function is carried out by the dimension of the plate 203 which is reduced in comparison with that of the other plates 106.

As already described in the initialization phase, by the effect of initially stopping the daisywheel in one of the rising zero points Xo of the signal FTA, a petal of conventionally 'even' position is aligned in front of the striker 16.

Figure 12:
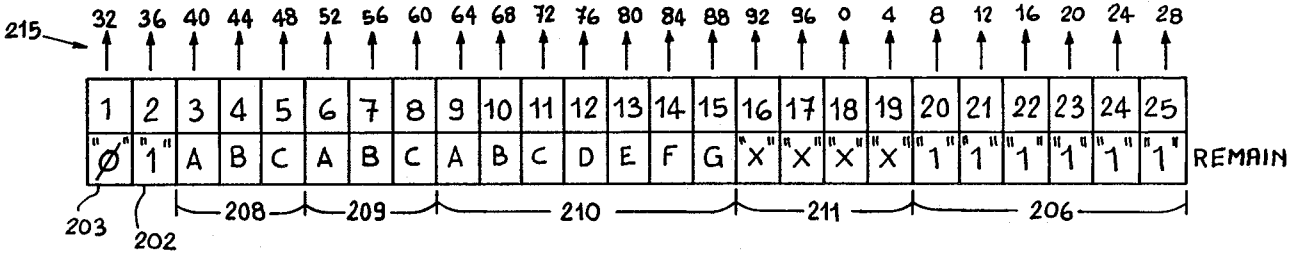
FIG. 12 is a representative layout of some elements of the character-carrying member shown in FIG. 4.

In the phase for recognition of the gap 206, the program proceeds to read REMAIN only as a consequence of incremental rotary movements of two petals in corespondence with the petals at even positions. Reading of the zone 206 which is without plates gives rise to an operation of counting twelve bits REMAIN=1 in the case where the last plate of the sector 211 corresponding to the petal in position 6 in FIG. 12 is present and had given rise to a signal REMAIN=0 at the output or trailing edge. In the case on the other hand where only the first place of the group 211 is present, corresponding to the petal in position 94, and its output or trailing edge had given rise to a bit REMAIN=1, the count will be equal to nineteen. In both cases the operation of reading at the plate 207 with recognition of the signal REMAIN=0 in correspondence with alignment of the petal in position 32 will take place reliably over a zone of the plate 207 which excludes the edges, in a theoretical reading position which is spaced one petal from its input edge and two petals from its output edge.

Reading of the plate 207 is thus reliable even if the plate were displaced in a clockwise direction as far as almost one petal and as far as two petals in an counterclockwise direction. When recognition of the gap has been confirmed, the subsequent operation of reading the other plates is effected by incremental rotary movements equal to four petals. The operation of reading the other plates thus occurs at the respective central zones and permits a positioning tolerance equal to almost two petals in the two directions of rotation.

FIG. 11 puts in phase relationship the state of the signal STA and the signal REMAIN, with the reading operations in respect of the logic blocks 221 and 222 in FIG. 10 and associated respectively with the petals in even positions and the petals in positions which are a multiple of four.

That result was made possible by virtue of using a synchronization disc which, having a period congruent with the angular distance between two petals, makes it possible to discriminate parity of position of the petals and to carry out the initialisation operation on only petals at even positions.

In accordance with a second embodiment of the invention, the reflective synchronization plate could also be of a width which is equal to that of the other plates. In order to avoid any uncertainty in regard to reading at the edge of the plates, all the plates would therefore have to be displaced by a petal with respect to the position in the first embodiment. Identification of the synchronization plate would be effected in a similar manner to that described hereinbefore. The subsequent operation of reading the code will therefore take place every four petals, corresponding to the petals at odd positions, after a jump of five petals. In that case, tolerance in regard to positioning of the plates would be limited to a single petal both in regard to the synchronization plates and in regard to the coded plates.

The presence of the control code in the zone 211 finally ensures that any accidental event which modifies the state of the signal REMAIN with respect to its theoretical value cannot introduce wrong information regarding the daisywheels which are actually used in the print unit of the typewriter.

Mechanical initialisation

In the case where the control code of the daisywheel 15 has not been recognised or the time intended for the optical recognition operation has elapsed, the program activates the mechanical initialization cycle 226 which is similar to that described in our above-mentioned U.S. Pat. No. 4,605,324.

The initialization cycle 226 follows the stoppage of the daisywheel 15 or 46 at a point Xo of the synchronization disc 32 (block 220) and provides (block 240) for lifting of the correction ribbon 55 and resilient contact of the tooth 59 against the cylindrical surface of the adaptor disc 44.

The program then provides a command for rotary movement in the counterclockwise direction equal to two petals (block 241). If the tooth 59 has not entered the recess 48, the rotary movement of the daisywheel may take place freely, and the program detects the start of two edges of the signal STA (junction 242) and activates a positional-type stop command (block 243). The same occurs if a time greater than that provided for that phase (junction 243) has elapsed.

The program proceeds with a programmed rotary movement at low speed and in a clockwise direction without time control for 101 annular increments (block 244). The program then continues with lowering of the corrector ribbon 55 (block 248) and consequential disengagement of the tooth 59 from the recess 58 and with zeroing of the registers of the RAMs 191 (block 233), either in the case of recognition of the one hundred edges of the signal STA (junction 245 and junction 246), indicative either that it is already in the zero position and that there has been rebounding or bouncing as between the tooth 59 and the recess 58, or in the case where the daisywheel has stopped, edges of the signal STA have not occurred and the timer has detected the elapsing of a period of time greater than that provided for.

In that case also, the use of a synchronization disc having a period double that of the petals makes it possible substantially to increase the tolerances in respect of the recess 58 and the tooth 59 and the degree of reliability of the initialization arrangement.

We claim:

1. A removable character-carrying disc, with a plurality of flexible character-carrying spokes according to a given character pitch, and reflective identification plates in coded angular positions, for a print unit of a typewriter, wherein said typewriter comprises a motor shaft which can be connected to a hub of the character-carrying disc, a selection means for controlling said motor shaft for incremental rotation of the disc to selectively position said characters for the printing of said characters, and recognition means for further controlling the rotation of the motor shaft and identifying a code associated with coded positions of the identification plates, wherein the spokes of a first half plurality have a conventional odd position and the spokes of the second half plurality are interspaced with the spokes of said first half plurality and have a conventional even position, wherein said code is of a multibit type, and said recognition means comprise:

an initialization circuit including first means to rotate the disc and arrest the disc in one of a series of arrest positions associated with concurrent alignment of said first half spokes with a printing point and displaced through an arrest angular pitch which is twice said character pitch, and second means for incrementally rotating said motor through sensing positions which are displaced through a sensing angular pitch which is twice said arrest angular pitch, wherein said second means have means for sensing the bits of said code concurrently with said sensing positions;

wherein said bits are defined by said reflective plates and the disc, as well as the identification plates, comprises a reflective phase timing phase associated with a zero position of the character-carrying disc, and each of the identification plates occupies an angular sector of constant width, substantially equal to said sensing angular pitch and to be sensed centered with respect to the location of the disc through said sensing positions;

wherein said phase timing plate is located in an angular sector preceded by a gap devoid of plates and said phase timing plate occupies an angular sector of an extent which is substantially less than that occupied by each identification plate to avoid ambiguity in its reading after said gap; and wherein the identification code is associated with four groups of identification plates, of which the first group concerns items of information relating to the spacing pitch of the characters, the second group concerns items of information relating to the intensity of printing which is on average required by the characters, the third group is concerned with the language to which the characters belong and the fourth group represents in binary coding the number of plates present in the other three groups.

2. A selector device for a character-carrying member having flexible spokes and identification elements in angular coded positions, comprising a print hammer; a motor shaft which can be positioned in a plurality of angular positions; clutch means for removably coupling the motor shaft to the character-carrying member in a plurality of predetermined engagement positions for selection of a spoke in front of the print hammer; and a detection member for detecting the presence of one of said identification elements in front of said detection member and generating a corresponding presence signal, wherein said clutch means comprises a driving portion fixed to said motor shaft and a driven portion carried by said character-carrying member;

wherein said character-carrying member is lodged in a lodging container which is movably supported to cause said driven portion to engage with said driving portion and wherein said lodging container further comprises a movable support cooperative with said character-carrying member and urged by a spring member to bias axially said character-carrying member in order to hold said driven portion engaged with said driving portion;

wherein said detection member is mounted on said movable support by means of an intermediate support such as to provide angular adjustment with respect to the print hammer to modify the position of said detection member with respect to the character-carrying member in correspondence with a position of alignment of each spoke with respect to the print hammer and for modifying the phase of said presence signal with respect to the position of alignment of said spokes; and wherein said identification elements comprise reflective plates which each occupy an angular sector congruent with the sector occupied by four spokes of the character-carrying member and wherein said detection member is formed by a photoelectric pair comprising a lighting element and a detector element disposed beside the lighting element and in which each plate reflects to the detection element the energy of the lighting element when the plate is disposed in front of said photoelectric pair.

3. A selector device according to claim 2, wherein the character-carrying member comprises a support hub for the reflective plates adjacent to the driven portion of said clutch means and wherein said intermediate support is connected with said movable support by means of an eccentric element which provides said angular adjustment.

4. A selector device according to claim 2 further comprising a position transducer having a movable portion connected with said motor shaft for generating a position signal associated with the angular position of the motor shaft with respect to a marker on a supporting carriage; servo-mechanism means responsive to said position signal for selectively positioning the motor shaft in a plurality of angular step positions for selection of one of said spokes in front of the print hammer; wherein said motor shaft is rotatable on a support frame which in turn can be fixed in an angularly variable manner with respect to a support portion of the carriage for modifying the angular positions of the marker with respect to the support portion of the carriage and defining a predetermined value in respect of the position signal from the transducer, in the condition of alignment of one of the character-carrying spokes with said print hammer.

5. A removable character-carrying disc with a plurality of flexible character-carrying spokes according to a given spoke pitch, and reflective identification plates in coded angular positions, for a print unit of a typewriter, wherein said typewriter comprises a motor shaft which can be connected to a hub of the character-carrying disc, a selection means for controlling said motor shaft for incremental rotation of the disc to selectively position said characters for the printing of said characters, and recognition means for further controlling the rotation of the motor shaft and identifying a code associated with coded positions of the identification plates, wherein the spokes of a first half plurality have a conventional odd position and the spokes of the second half plurality are interspaced with the spokes of said first half plurality and have a conventional even position, wherein said code is of a multibit type, and said recognition means comprise:

an initialization circuit including first means to rotate the disc and arrest the disc in one of a series of arrest positions associated with concurrent alignment of said first half spokes with a printing point and displaced through an arrest angular pitch which is twice said spoke pitch, and second means for incrementally rotating said motor through sensing positions which are displaced through a sensing angular pitch which is twice said arrest angular pitch, wherein said second means have means for sensing the bits of said code concurrently with said sensing positions;

wherein said bits are defined by said reflective plates and the disc, as well as the identification plates, comprises a reflective phase timing plate associated with a zero position of the character-carrying disc, and each of the identification plates occupies an angular sector of constant width, substantially equal to said sensing angular pitch and to be sensed centered with respect to the location of the disc through said sensing positions;

wherein said phase timing plate is located in an angular sector preceded by a gap devoid of plates and said phase timing plate occupies an angular sector of an extent which is substantially less than that occupied by each identification plate to avoid ambiguity in its reading after said gap; and wherein the angular sector occupied by each identification plate is substantially congruent with the sector occupied by four character-carrying spokes of the disc and the angular sector occupied by the reflective phase timing plate is substantially congruent with three spokes.

6. A character-carrying disc according to claim 5, wherein the character-carrying member carries one hundred spokes, in which the sector of said gap comprises at least six sectors each of four spokes and a further sector of one spoke, and wherein the sector of said phase timing plate is followed by a plate-free sector of four spokes along a complete ring of twenty five different angular sectors of the disc.

7. A removable character-carrying disc with coded identification elements for a print unit of a typewriter, comprising a motor shaft which can be connected to a hub of the character-carrying disc for rotation of said disc; an electronic circuit comprising reading means for detecting the presence of one of the coded elements in front of a given index in given angular positions of the disc and generating a corresponding signal; recognition means operatively connected to the reading means for forming a multibit code, wherein said multibit code comprises a group of identification bits and a group of reference control bits, wherein said group of identification bits is provided for identification of the disc; and the combination comprising:

checking means responsive to said group of identification bits for generating a group of calculated control bits univocally associated with said group of identification bits; and control means for comparing said group of calculated bits and said group of reference control bits accepting said group of identification bits if equality is achieved, wherein the group of identification bits is associated with a first group of said coded identification elements;

wherein the group of reference control bits is associated with a second group of said coded identification elements which are encoded to generate said group of reference control bits equal to said group of calculated control bits, for enabling said control means to verify the correct reading of all said coded identification elements; and wherein said reading means comprise a photoelectric pair, formed by a lighting means and a detector means, wherein said coded elements comprise a plurality of reflective plates which can be detected by the photoelectric pair of said reading means, and wherein said plurality of plates comprises three groups of plates which define said identification bits and represent three characteristic parameters of the disc and a fourth group of plates which defines the reference control bits.

8. A character-carrying disc according to claim 7, wherein the fourth group of plates represents in binary code the sum of the number of reflective plates contained in the three groups of plates which define said identification bits.

* * * * *